United States Patent [19]

Müller

[11] 4,137,121

[45] Jan. 30, 1979

[54] DEVICE FOR ATTACHING SPECIFICALLY TAPELIKE CUTS TO CONTAINERS

[75] Inventor: Alois Müller, Barbing, Fed. Rep. of Germany

[73] Assignee: Hermann Kronseder, Worth, Fed. Rep. of Germany

[21] Appl. No.: 832,256

[22] Filed: Sep. 12, 1977

[30] Foreign Application Priority Data

Sep. 18, 1976 [DE] Fed. Rep. of Germany ..... 2642046

[51] Int. Cl.[2] ..... B65C 9/08

[52] U.S. Cl. ..... 156/571; 118/221; 118/255; 156/578; 221/210; 271/33

[58] Field of Search ..... 156/291, 566, 309, 571, 156/314, 578, DIG. 16, 17, 32, 35, 475, 568; 427/207 A, 286; 221/210; 271/33; 118/221, 255; 428/198, 347, 200, 914, 211

[56] References Cited

U.S. PATENT DOCUMENTS

| | | | |
|---|---|---|---|
| 2,054,448 | 9/1936 | Russell | 156/291 |
| 3,196,070 | 7/1965 | DellaVite | 118/221 |
| 3,673,043 | 6/1972 | Carter | 156/475 |
| 3,788,921 | 1/1974 | Polit et al. | 156/477 B |
| 3,865,671 | 2/1975 | Kronsder | 156/578 |
| 3,923,589 | 12/1975 | Tavernier | 156/571 |
| 4,072,555 | 2/1978 | Gau | 156/571 |

FOREIGN PATENT DOCUMENTS

| | | | |
|---|---|---|---|
| 1844970 | 11/1962 | Fed. Rep. of Germany. | |
| 262669 | 12/1926 | United Kingdom | 427/286 |

OTHER PUBLICATIONS

"Krones Handbook of Labelling Technology" pp. 31–32 ©1975.

*Primary Examiner*—William A. Powell
*Assistant Examiner*—J. J. Gallagher
*Attorney, Agent, or Firm*—Wheeler, Morsell, House & Fuller

[57] ABSTRACT

A central band of cold glue is applied over most of the length of a label. Each label is then engaged by one of several circumferentially spaced gripper fingers on a rotating head which causes the labels to pass a hot glue applicator which applies bands lengthwise of the label on each side of the central cold glue band. Each label is finally rotated to a properly positioned container where a reciprocable squeezer presses the label onto the container.

1 Claim, 4 Drawing Figures

FIG. 2
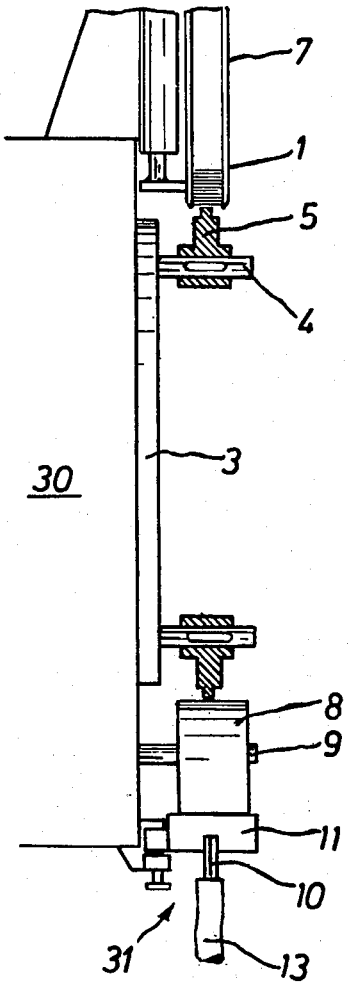
FIG. 3
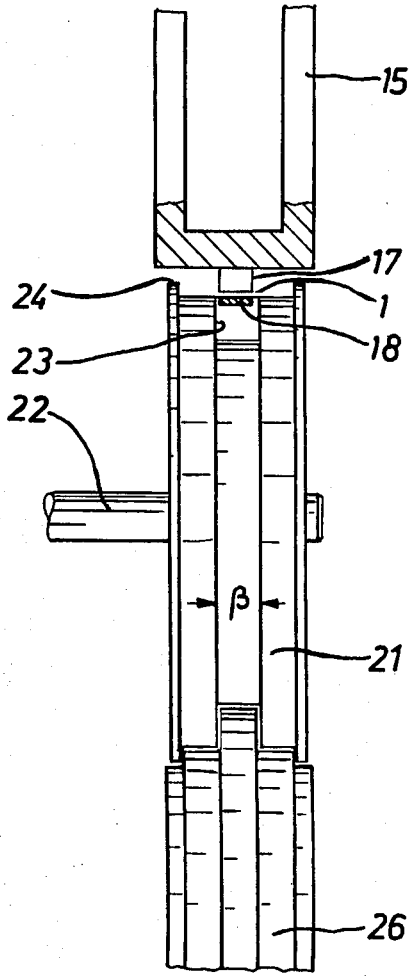
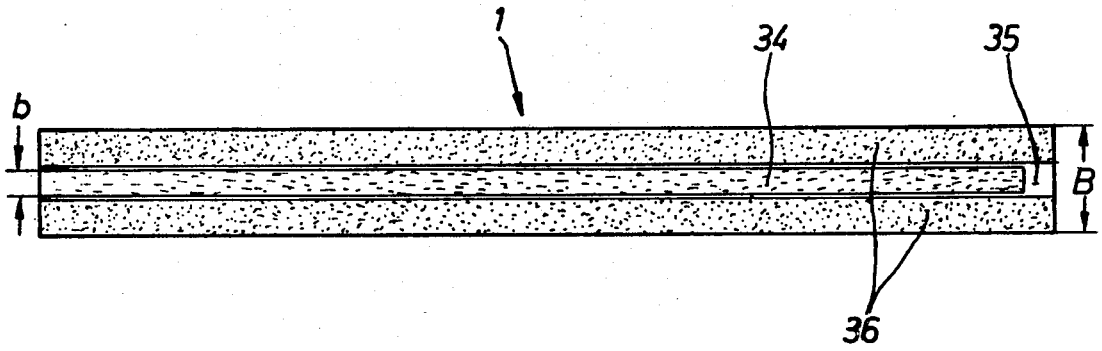
FIG. 4

DEVICE FOR ATTACHING SPECIFICALLY TAPELIKE CUTS TO CONTAINERS

BACKGROUND OF THE INVENTION

The invention relates to a process and apparatus for attaching specifically tapelike strips such as labels to containers where the strips are separated individually from a supply stack and fed to the containers after having been provided with a heat-seal coating.

In connection with applying labels, film cuts or other strips to containers such as bottles, cold glues are commonly used. Most cold glues are based on dextrin, casein or starch. These materials are inexpensive and can be processed at room temperatures without any trouble. Initially, the adhesion is relatively low, however, so that large contact surfaces are required between label and container for preventing slippage of the label during subsequent brush-on. Cold glues are unsuitable for bonding to metallic surfaces. The so-called heat-seal or thermoplastic adhesives, which for processing purposes must be heated substantially above room temperature, have a substantially higher adhesive power. They are more expensive than cold glues but they are not wholly trouble free and they require expensive heating installations. Therefore, heat-seal adhesives are usually used only in special cases such as for the attaching of control tapes and labels to containers.

For example, there is a known process of the initially indicated type, where the labels are taken off of a supply stack by vacuum means and on their way to the containers are provided with a heat-seal adhesive coating after which they are pressed on with their center part to the container closure caps (U.S. Pat. No. 3,097,983). With this exclusively heat-seal using process the labels are seated — despite their limited contact surface — even on metallic closure caps in a relatively tight way and, therefore, can hardly slip off center during the further feeding and pressing on of both of their still projecting ends. A remaining disadvantage is that even under vacuum produced withdrawal conditions the labels can slip off center so a uniform appearance of containers and an accurate seating of labels cannot be guaranteed. Furthermore, vacuum operated withdrawal devices require substantial operating time and, hence, slow down production.

There is another known process for attaching file index labels to bottles where tapelike labels are withdrawn through adhesion to glue, are glued in the process and then pressed on to the bottles (DOS 2,055,417). With this process obviously involving the exclusive use of cold glue, the initial adhesive power of labels on the bottles is relatively low which requires a complicated press-on stage and a long, process delaying press-on time. Even so, this does not prevent a slippage of labels.

SUMMARY OF THE INVENTION

An object of the invention is to create — by starting with a process of the initially indicated type — a process for adhering tapelike strips to containers which can operate at high speed and yet permit trouble free isolation of strips.

A more specific object is to provide a process and apparatus for applying strips such as labels to a container by sequentially applying inexpensive cold-glue to a label over a limited area and heat sealable glue over another area of the label for the latter to eliminate the possibility of shifting as soon as the strip stikes the container.

A further object is to provide a simple but effective apparatus for carrying out the process.

According to the invention, that strips are adhesively taken off the supply stack by adhesive coated pivotal orbiting carriers such that a first part of each strip is provided with a cold-glue layer, and then in the course of feeding the strips toward the containers, a second part of each strip differing from the first part is provided with a hot-seal adhesive layer.

The process, according to the invention, produces an accurate repeatable, trouble free and rapid strip withdrawal and simultaneously a high initial adhesion. That way, also very small strips with a correspondingly minor contact surface can be attached to containers, and their metallic closure caps, at a high production rate. Thus, the production impediment existing up till now with the processing of labels is overcome in a simple manner, and the same output rates with excellent operating results can be achieved as they usually are with standard labels for some time now but without the disadvantages of inaccurate label placement due to slippage and without inadvertent peeling of the labels as they are being pressed on the containers.

An especially advantageous and improved feature, according to the invention, is that both cold-glue and heat-seal coatings are applied in the shape of bands or stripes and that cold-glue stripes and heat-seal stripes alternate in sequence. That way, on the one hand an accurate withdrawal from the supply stack and, on the other hand, a good seating on the containers is obtained.

According to another improved feature of the invention, the bands or stripes of adhesive coating are applied in the lengthwise direction of each strip. This measure too contributes to repeatable successful withdrawal and non-shifting fixation of the strips.

According to another improved feature of the invention, only one cold-glue stripe in the center of each strip and two laterally adjacent heat-seal stripes are applied. Such a process is particularly simple to carry out.

According to another advanced development of the invention, narrow glue-free zones remain between cold-glue and heat-seal stripes. That way, a mutually effective mixup of both adhesive stripes and/or means of their application is safely avoided.

A good doctoring and uniform glueing is accomplished in such a way that according to a further feature of the invention bother cold-glue and heat-seal stripes or layers are applied by the rolling off of glue from carrier surfaces onto the strips.

Another new and advantageous feature of the invention is that on applying the heat-seal coating to the second part of the strip only the first part of the strip is at least partially supported or gripped. This is to prevent, in case labels are skipped, any support or feeder means from being loaded with hot-seal glue.

With respect to the new apparatus, which cooperates with some known apparatus to perform the new process, the labeling device includes a magazine feed for stacked strips, a withdrawal device for taking individual strips out of the magazine, a rotating gripper cylinder for taking strips from the withdrawal device and pressing them on to containers, a rotating glue roller on the gripper cylinder which is connected to a hot-glue feeder device and which provides gripper-cylinder circumferentially carried strips with a hot-glue coated stripe or band. The withdrawal device has a carrier equipped with at least one adhesive coated surface for rolling off the applicably leading part of a strip in the magazine, and there is a glue roller for applying glue to carrier surfaces. The roller is supplied from a cold-glue feeder device and each adhesive stripe has smaller area than the strips, or in other words, covers only with a first part of each strip, and the glue roller on the gripper-cylinder is so developed that it contacts a second part of each strip differing from its first part.

How the above mentioned and other objects and features are achieved will appear in the more detailed description of an embodiment of the invention which will now be set forth in reference to the drawings.

DESCRIPTION OF THE DRAWINGS

FIG. 2 is a section taken along line ABC in FIG. 1;

FIG. 3 is a section taken along line DEF in FIG. 1; and,

FIG. 4 shows the backside of a glued label strip on which cold and hot-glue stripes have been applied.

DESCRIPTION OF A PREFERRED EMBODIMENT

Figure 1:
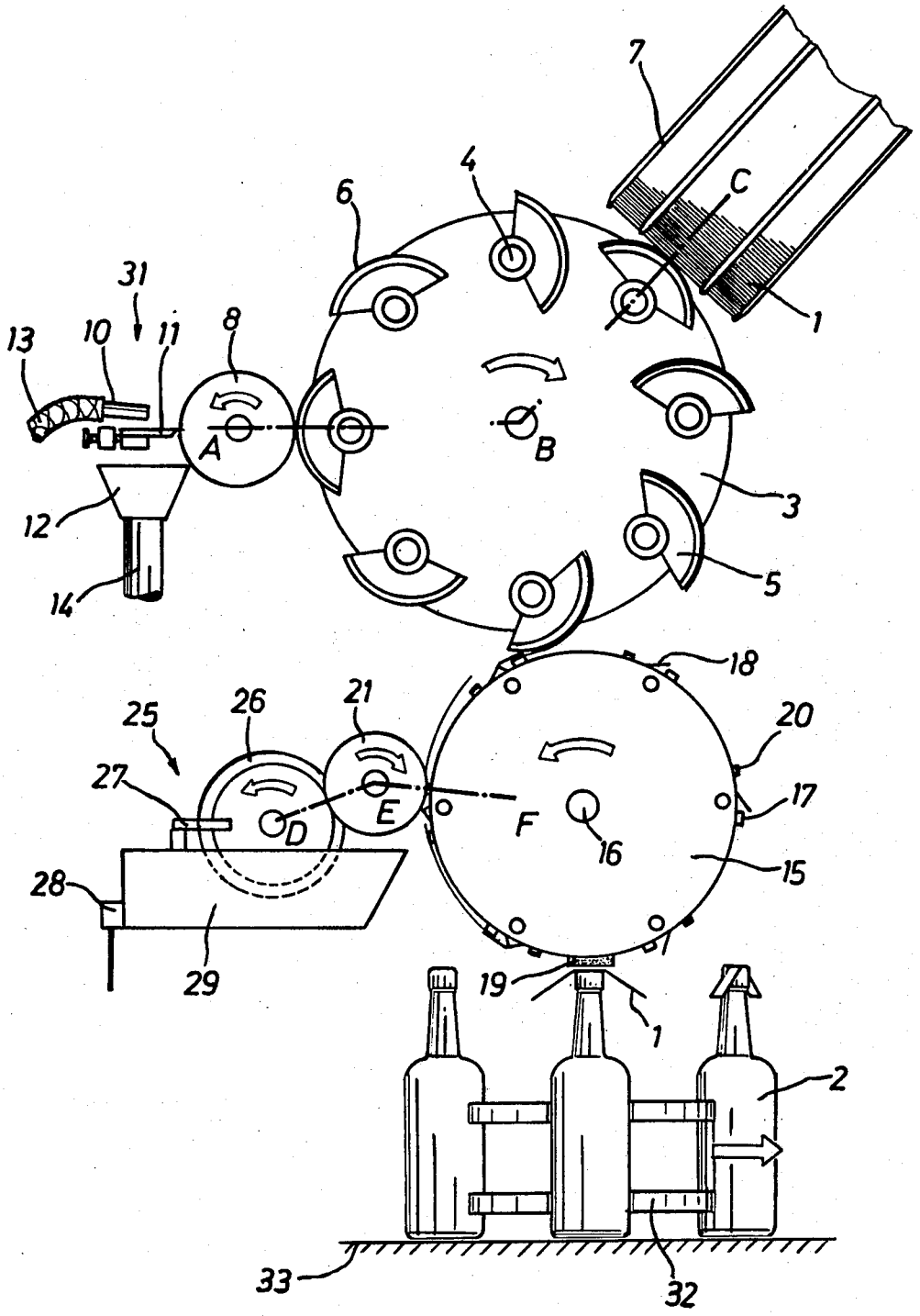
FIG. 1 is a lateral view of a device for attaching labels to bottle tops.

The device according to FIGS. 1 through 3 is adapted for attaching tape-like labels 1, hereafter called strips 1, to closures and/or tops of upright standing bottles 2, and is part of a bottling machine not further shown. It has a rotatably supported turret-like head 3, which is driven in the direction of the arrow. The head has several swivelably supported shafts 4. Attached to each shaft 4 is a segment-shaped withdrawal member 5 having curved peripheral surfaces of adhesion 6. In operation, cold glue is applied to curved surfaces 6 by a glue applicator roller 8 and, as the segments orbit due to rotation of head 3, their glue coated peripheries pick up one strip 1 at a time from a stack of label strips in a magazine 7. The width b, see FIG. 4, of each area of adhesion 6 measured in the axial direction of head 3 is smaller than the width B of labels 1, that is, the areas of adhesion are surfacewise smaller than the labels, while the length of each area of adhesion substantially corresponds to the length of labels. On rotating head 3, the shafts 4 are oscillation driven by a not-shown control device. The magazine 7 for retaining stacked labels is stationary with respect to the rotary direction of head 3, so the adhesive coated curved surfaces 6 of oscillating withdrawal members 5 roll off the center area of the leading label as illustrated in FIG. 2.

The first cold-glue roller 8 is supported for rotation with shaft 9 and is arranged for applying glue to the bare curved surfaces 6. Shaft 9 is driven in the direction of the arrow, preferably in synchronization with the head with a rotary speed corresponding to the linear speed of the area of adhesion passing by. Associated with glue roller 8 is a cold-glue feeder device 31 comprising a glue dispenser nozzle 10, a timeable glue bar 11 for regulating the glue-film thickness, and a glue cup 12 which catches glue drippage. Glue nozzle 10 is connected to a glue-feeding pump (not shown) by way of tube 13, while glue cup 12 is connected by way of a pipe 14 to an also not-shown glue reservoir from which the pump draws glue. Thus, a closed glue circulation loop is provided which permits the cold glue to be maintained at a uniform consistency.

Arranged on adjacent head 3 is a gripper cylinder 15 cooperating with said head 3 and having a rotary supported shaft 16, which is in synchronization with the head and driven in the direction of the arrow. The gripper cylinder is equipped with gripper rests 17, pivotal gripper fingers 18, radially shiftable, elastic pressed-on members 19, and suction nozzles 20 connectable to a vacuum source. Gripper fingers 18, press-on members 19, and the suction nozzles 20 are controlled according to operating conditions by a control device (not shown). The fingers 18 and rests 17 comprise releasable strip holding means operative on cylinder 15.

A second glue roller 21 for glueing labels 1 on its circumference is fixed to a rotary supported shaft 22, which is driven in an arrow-following direction, preferably synchronously to and at a lower rotary speed that the adjacent gripper cylinder 15. As can be seen from FIG. 3, the second glue roller 21 has a central annular groove 23, the width beta of which exceeds that of gripper rests 17 and gripper fingers 18, and the groove also exceeds slightly the width b of cold-glue coated segments 6. By way of properly associating glue roller 21 with gripper cylinder 15 any contact between them is eliminated, that is, the gripper fingers 18 and also gripper rests 17 extend into annular groove 23, whereby the gripper finger held strips or labels 1 are pressed on to the glue roller 21 rims on each side of the groove. For better label guidance the second glue roller 21 is provided with lateral journal shoulders 24, the interspacing of which is somewhat wider than the label width B.

The second glue roller 21 is connected with a hot-glue feeding device 25, consisting of an applicator roller 26 with a stripper 27, and a glue pan 29 heated by a thermostatically controlled heater 28. The applicator roller 26 is exactly contoured to fit the second glue roller 21 to prevent excessive glue accumulations on the latter. Furthermore, the applicator roller 26 can be radially timed with glue roller 21 for regulating the glue-film strength. The glue storage pan 29 is filled with hot glue, which is kept at the required processing temperature by heater 28. Above described device components are attached to a housing 30 and/or rotatably supported in it. This housing 30 is so mounted via a conventional conveyor star 32 of the bottling machine, not shown, that the gripper cylinder 15 cooperates with the travel path of bottles 2. Housing 30 contains the drive elements, not shown, for rotating head 3, the first glue roller 8, the second glue roller 21, the gripper cylinder 15 and in any given case the applicator roller 26, and is in gear train connection with the conveyor star 32, so that all above listed components are driven synchronously at an optimal rotary speed. Bottles 2 are kept in the pockets of the conveyor star 32 by not-shown stationary guides, and are based on a stationary gliding plane 33.

The operation of the above described device and/or the process carried out with it is as follows:

On passing the first glue roller 8, each curved segment rolls on the glue roller and thereby gets a coating of cold glue. The coated curved segment, on passing magazine 7, rolls on the leading label 1 and thereby applies glue to the label and takes same off of the stack by adhesion. Thus, the first part of a label backside is provided with a cold-glue layer 34 in the shape of a longitudinal center stripe or band of an area-of-adhesion width b. This stripe 34 terminates at the label edge away from the gripper finger, while at the gripper finger-near end a short central zone 35 stays glue-free in order not to dirty the gripper finger later to be applied here. This is accomplished by proper recesses in segments 6 and- /or by the proper dimensioning of their length. On arriving at the gripper cylinder 15, the label 1 is clamped between a gripper rest 17 and associated gripper finger 18 and subsequently peeled off the segment 6 by equivalently driven gripper cylinder 15. Then the label 1 is passed along glue roller 21, whereby a second backside part differing from the first part is provided with a hot-glue layer 36 in the shape of two longitudinal-run stripes or bands. These stripes extend over the entire length of the label, bilaterally adjacent to but narrow-spaced apart from the cold-glue layer 34, so that narrow, non-glued zones remain. On terminating the glueing stage the rear end of the label is additionally caught by the now switched-in suction nozzle 20 and, thus, fed on to the bottles 2. Finally, the gripper finger 18 is opened, the suction nozzle 20 switched off and the press-on member 19 is moved out radially so that the center area of label 1 is pressed on to the topside of the bottle 2 closure and is adhesively kept there. Subsequently the bottle 2 is fed to a not shown post-treatment station, where both projecting ends of the label are laterally pressed on to the bottle neck.

By deviating from above described exemplified embodiment the process according to the invention can be applied also to other strips, such as standard labels, whereby preferably both cold-glue and hot-glue layers are produced by several stripes. It is feasible also to spray on the hot glue.

I claim:

1. Apparatus for applying strips such as labels to articles such as containers wherein a supply stack of strips is provided, comprising:

rotatably driven turret means, a plurality of members having curved surfaces mounted on said turret means for being turned and for being moved in an orbit when said turret means rotates, the axially extending width of said curved surfaces being less than the width of said strips, and the circumferentially extending length of said curved surfaces being short of the length of said strips, said curved surface making contact centrally of said strips, roller means adjacent the orbital path of said members for applying cold glue to said surfaces as they pass said glue applying means, said stack of strips being disposed relative to said orbital path for said surfaces to effect a rolling action on only the central lengthwise extending portion of said strips in said stack to thereby apply a first stripe of cold glue to said central portion of a strip short of the length of said strip and for withdrawing it from said stack and leaving a short zone at the end of said stripe where no cold glue is applied, another rotatably driven generally cylindrical means adjacent the orbital path of said members and means on said cylindrical means for gripping said orbiting strips at the end of the first stripe where glue has not been applied to thereby cause removal of said strips from said surfaces and their transfer to said cylindrical means, another roller means having a central annular groove at least as wide as said first stripe for applying additional stripes of hot melt glue over the full length of the strips and to parts of said strips on opposite sides of where said first stripe of glue had been applied as said strips rotate with said cylindrical means, and means for transferring said strips from said cylindrical means to articles after said additional stripes of glue are applied.

* * * * *